US006343135B1

(12) United States Patent
Ellero et al.

(10) Patent No.: US 6,343,135 B1
(45) **Date of Patent: *Jan. 29, 2002**

(54) RETRACTABLE SPEAKER ASSEMBLY FOR A PARTITION

(75) Inventors: Steve Ellero, Woodbridge; Marco Marchione, Bolton; Larry Ellero, Woodbridge, all of (CA)

(73) Assignee: Elmark Technologies Incorporation, Woodbridge (CA)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/096,518

(22) Filed: Jun. 12, 1998

(51) Int. Cl.[7] ..... H04R 25/00

(52) U.S. Cl. ..... 381/387; 381/345; 381/386; 381/87; 181/199

(58) Field of Search ..... 381/86, 87, 386, 381/387, 390, 150, 152; 181/199; 362/364

(56) References Cited

U.S. PATENT DOCUMENTS

| | | | | | |
|---|---|---|---|---|---|
| 3,707,201 | A | | 12/1972 | Domin et al. | |
| 4,484,658 | A | * | 11/1984 | Grote | 381/386 |
| 4,673,149 | A | * | 6/1987 | Grote et al. | 362/364 |
| 4,891,842 | A | | 1/1990 | Green | |
| 4,923,032 | A | | 5/1990 | Nuernberger | 381/386 |
| 5,285,501 | A | | 2/1994 | Castillo | 381/86 |
| 5,321,760 | A | | 6/1994 | Gray | 381/86 |
| 5,400,407 | A | * | 3/1995 | Cassity et al. | 381/386 |
| 5,574,796 | A | | 11/1996 | Keezer | 381/386 |
| 5,734,732 | A | * | 3/1998 | Lemmon | 381/386 |
| 5,828,765 | A | * | 10/1998 | Gable | 391/386 |
| 5,937,073 | A | * | 8/1999 | Van Gieson | 381/387 |
| 6,101,262 | A | * | 8/2000 | Haase et al. | 381/386 |

FOREIGN PATENT DOCUMENTS

| | | | |
|---|---|---|---|
| DE | 969 637 | | 6/1958 |
| DE | 44 40 583 | | 5/1996 |
| EP | 0 338 481 | * | 4/1989 |
| EP | 0 338 481 | | 10/1989 |
| EP | 0 356 298 | | 2/1990 |
| FR | 2 550 742 | | 2/1985 |
| FR | 2 733 382 | | 10/1996 |

* cited by examiner

*Primary Examiner*—Sinh Tran
*Assistant Examiner*—P. Dabney
(74) *Attorney, Agent, or Firm*—Eugene J. A. Gierczak

(57) ABSTRACT

A retractable speaker assembly for a partition, such as a ceiling, having a housing containing a speaker, a cavity, an actuator and a panel. The housing is concealed by the panel when the assembly is in a closed position, and is exposed when the assembly is in an operable position. The actuator moves the assembly between the closed and operable positions. The panel is positioned in such a way that the cavity that contains the assembly is concealed by the panel.

4 Claims, 9 Drawing Sheets

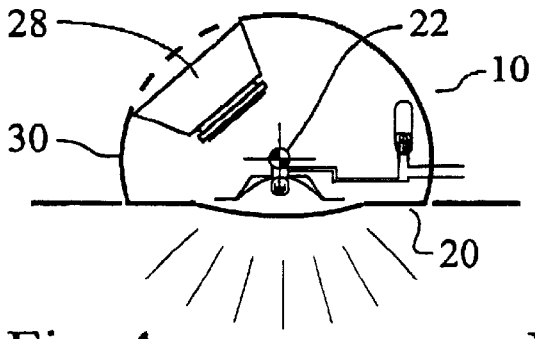
Fig. 4a
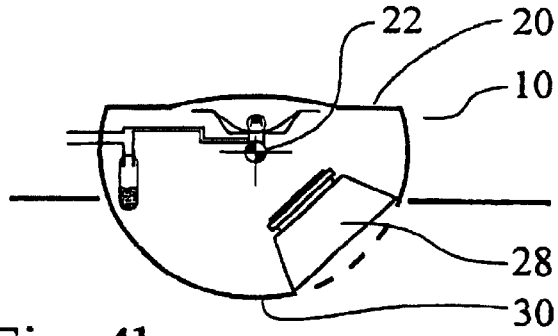
Fig. 4b
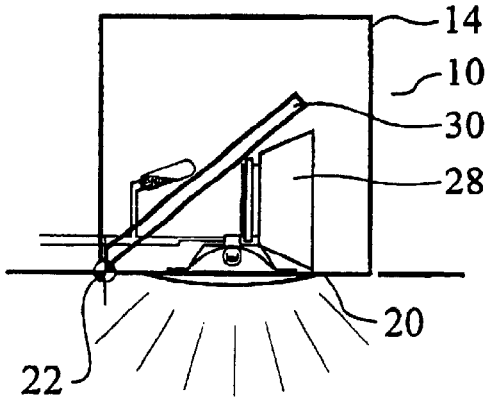
Fig. 5a
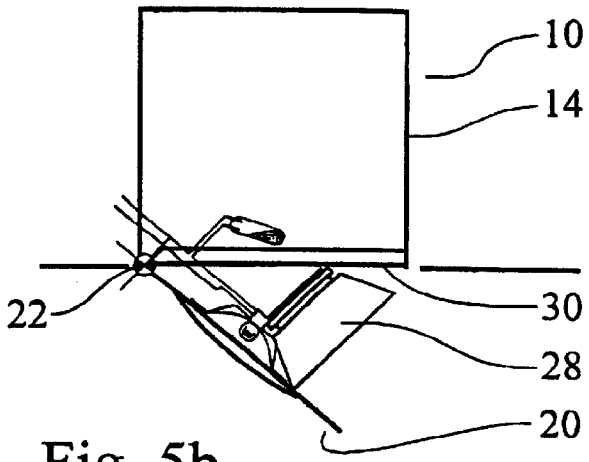
Fig. 5b
Fig. 5c
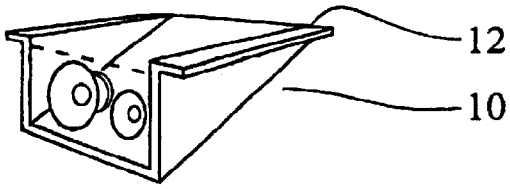

RETRACTABLE SPEAKER ASSEMBLY FOR A PARTITION

FIELD OF INVENTION

This invention relates generally to audio speakers, and more specifically to a retractable speaker assembly for a partition.

BACKGROUND OF INVENTION

Audio speaker systems have traditionally been mounted or installed into homes so that the audio speaker systems and specifically the speaker are visible to the occupants of the room. Since the speaker size is often significant, an ability to conceal the speaker so as to improve the overall appearance of the room would be desirable.

Prior art audio speaker systems for a room and for an automobile have tried to address some of the aforenoted problems.

U.S. Pat. No. 5,321,760 issued on Jun. 14, 1994 to Davidson Textron Inc. of Dover, N.H. by assignment from the inventor John D. Gray. This patent relates to a housing in which is mounted a speaker. The housing is mounted on a platform which is attached by trunnions to corresponding mounts. Mounts are secured to an automobile window ledge that extends between a rear seat and a rear window of the automobile, the housing is capable of rotation about an axis extending through the center of trunnions. Operation of actuator in the clockwise direction causes platform, and thus housing, to rotate upwards about axis from the retracted position to the extended position. Sideways rotation of housing is achieved by an actuator mounted on the topside of platform.

U.S. Pat. No. 5,285,501 issued on Feb. 8, 1994 to the inventor Harry A. Castillo. This patent relates to an arcuate speaker which is arranged for pivotal mounting relative to a vehicular rear shelf plate in operative communication with a cover plate, wherein pivoting of the speaker in communication with a bottom surface of the rear shelf plate effects pivotal displacement of the cover plate for audible access of the speaker relative to an associated passenger compartment of the vehicle.

U.S. Pat. No. 4,932,032 issued to Mark A. Nuernberger on May 8, 1990. This patent relates to a ceiling panel sound system having a completely self-containing high fidelity speaker system that is installed in a supporting gridwork for a suspended ceiling. The speakers are installed in a rectangular mounting panel having a shape that corresponds to the ceiling tile.

U.S. Pat. No. 5,574,796 was issued on Nov. 12, 1996 to Bose Corporation of Farmingham, Mass. This patent relates to a mount for mounting a loudspeaker in a room boundary structure having an outside surface away from the inside of the room which includes a frame constructed and arranged to rest on the outside surface. A spring has a first end attached to the frame and a free second end. The spring is constructed and arranged to exert a unidirectional force toward the outside surface whenever the second end of the spring is displaced from the outside surface toward the inside of the room.

Daniel N. Green, the inventor, assigned U.S. Pat. No. 4,891,842 which issued on Jan. 2, 1990 to Posh Diversified Inc. of Oregon. This patent relates to an assembly for mounting a loudspeaker in a ceiling including a layer of sheet material, said assembly comprising: a mounting plate having an inner edge defining a circular opening; a circular ring extending down from the inner edge of said plate around said opening for forming an abutment to said sheet material of said ceiling; a recessed circular shoulder extending inward from the inner edge of said plate around said opening for mounting a loudspeaker in said opening; and a cover plate for covering said opening in said mounting plate, said cover plate including a screen and adapted for being removably mounted onto said circular ring in said mounting plate.

SUMMARY OF THE INVENTION

The object of one aspect of the invention is to provide an improved retractable speaker assembly for installation in a partition.

In accordance with one aspect of the invention there is provided a retractable speaker assembly for a partition having a housing, a cavity, and actuator and a panel where the housing is retractable from a first closed position to a second operable position by the actuator. The partition may conceal the housing when the speaker assembly is in the first closed position. In the second operable position the housing is exposed. The panel is associated with the housing in such a way that the cavity is closed when the housing is in the first closed position.

In accordance with yet another aspect of the invention, there is provided a retractable speaker assembly for a ceiling having a housing, a cavity, and actuator and a panel where the housing is retractable from a first closed position to a second operable position by the actuator. The ceiling may conceal the housing when the speaker assembly is in the first closed position. In the second operable position the housing is exposed. The panel is associated with the housing in such a way that the cavity is closed when the housing is in the first closed position.

In accordance with still another aspect of the invention, there is provided a retractable speaker assembly further comprising a pivot means such that the panel is retractable relative to the partition by the pivot means.

In accordance with a further aspect of the invention, there is provided a retractable speaker assembly where the actuator is a rack and pinion means.

An advantage of the present invention over the prior art is that the speaker assembly is retractable into the partition and concealed by the panel when the system is not operating, yet the speaker assembly is then visible and oriented for optimum sound when the system is in the second operable position.

BRIEF DESCRIPTION OF DRAWINGS

A detailed description of the preferred embodiments are provided herein below by way of example only and with reference to the following drawings, in which:

FIGS. 4*a–b,* in cross-sectional side views, illustrate a retractable speaker assembly for a partition, in operation, in accordance with a preferred embodiment of the present invention.

FIGS. 5*a–b,* in cross-sectional side views, illustrate a retractable speaker assembly for a partition, in operation, in accordance with a preferred embodiment of the present invention.

FIG. 5*c,* in a perspective view, illustrate a retractable speaker assembly for a partition, in accordance with a preferred embodiment of the present invention.

Figure 1D:
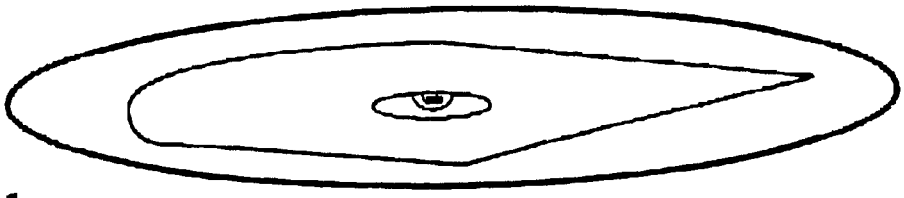
FIGS. 1*a–d,* in perspective views, illustrate a retractable speaker assembly for a partition, in operation, in accordance with a preferred embodiment of the present invention.
Figure 1C:
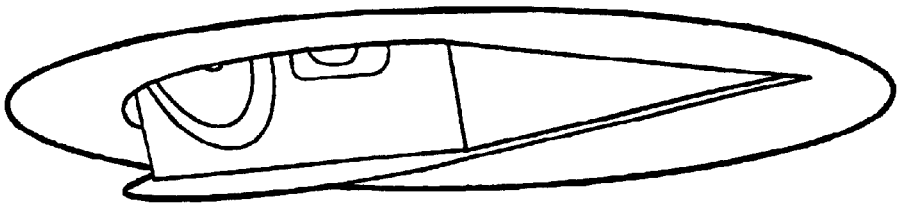
Figure 1B:
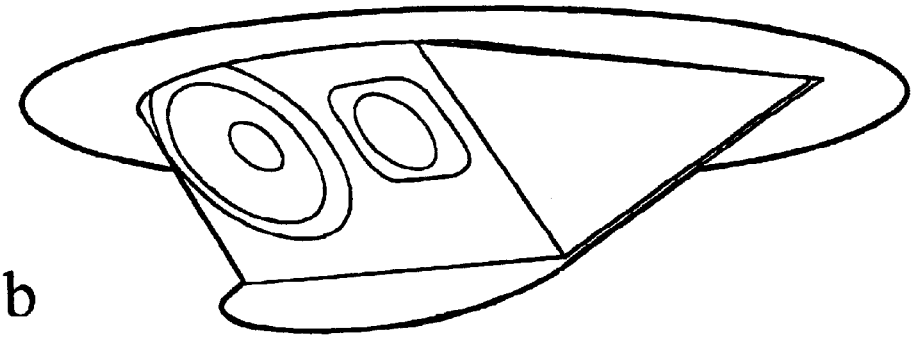
Figure 1A:
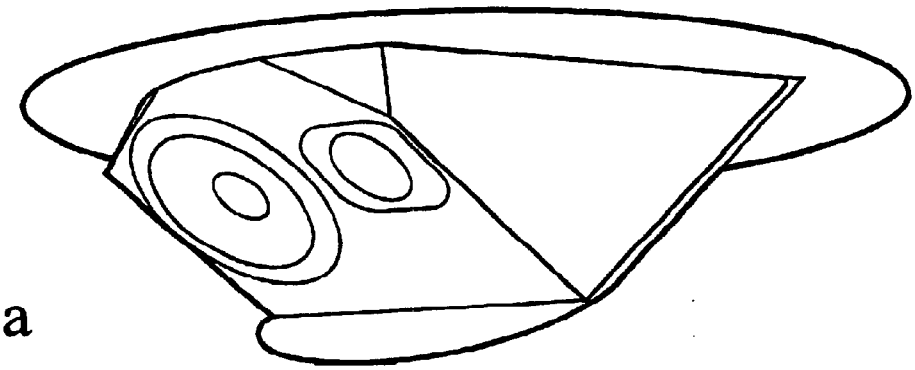
Figure 2A:
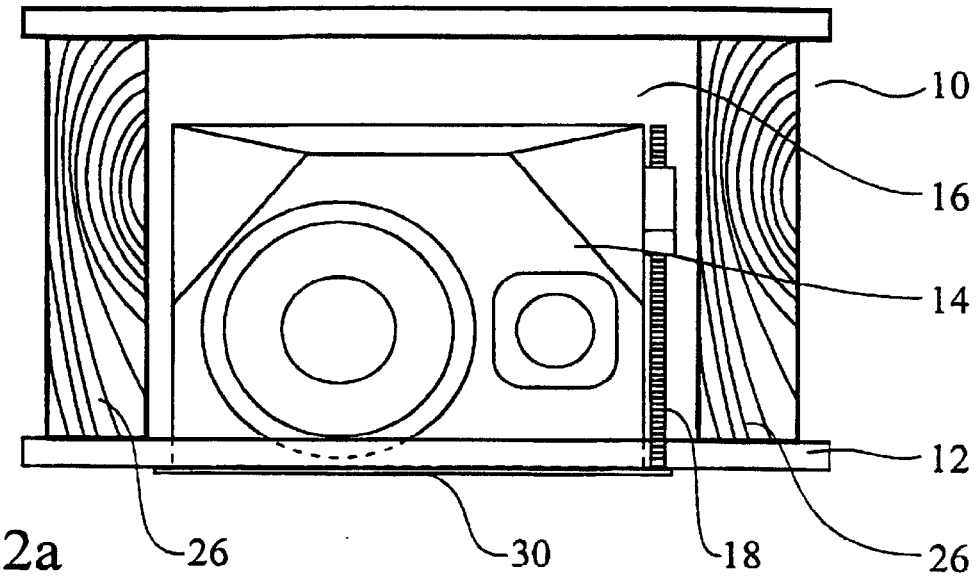
FIGS. 2*a–b,* in cross-sectional front views, illustrate a retractable speaker assembly for a partition, in operation, in accordance with a preferred embodiment of the present invention.
Figure 2B:
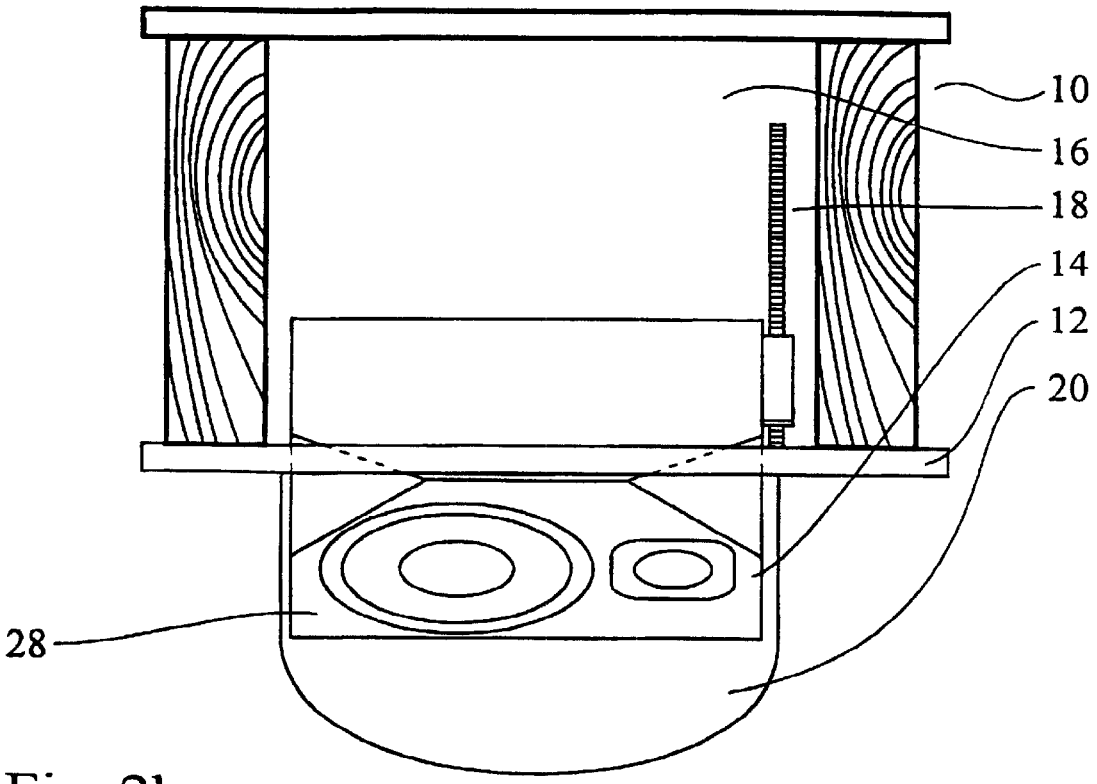
Figure 3A:
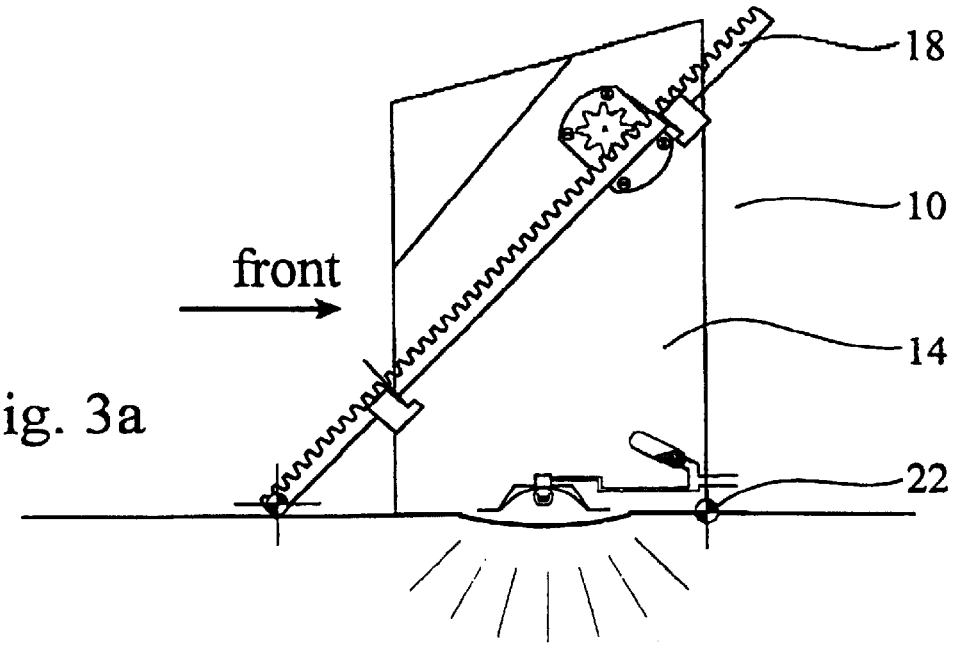
FIGS. 3*a–b,* in cross-sectional side views, illustrate a retractable speaker assembly for a partition, in operation, in accordance with a preferred embodiment of the present invention.
Figure 3B:
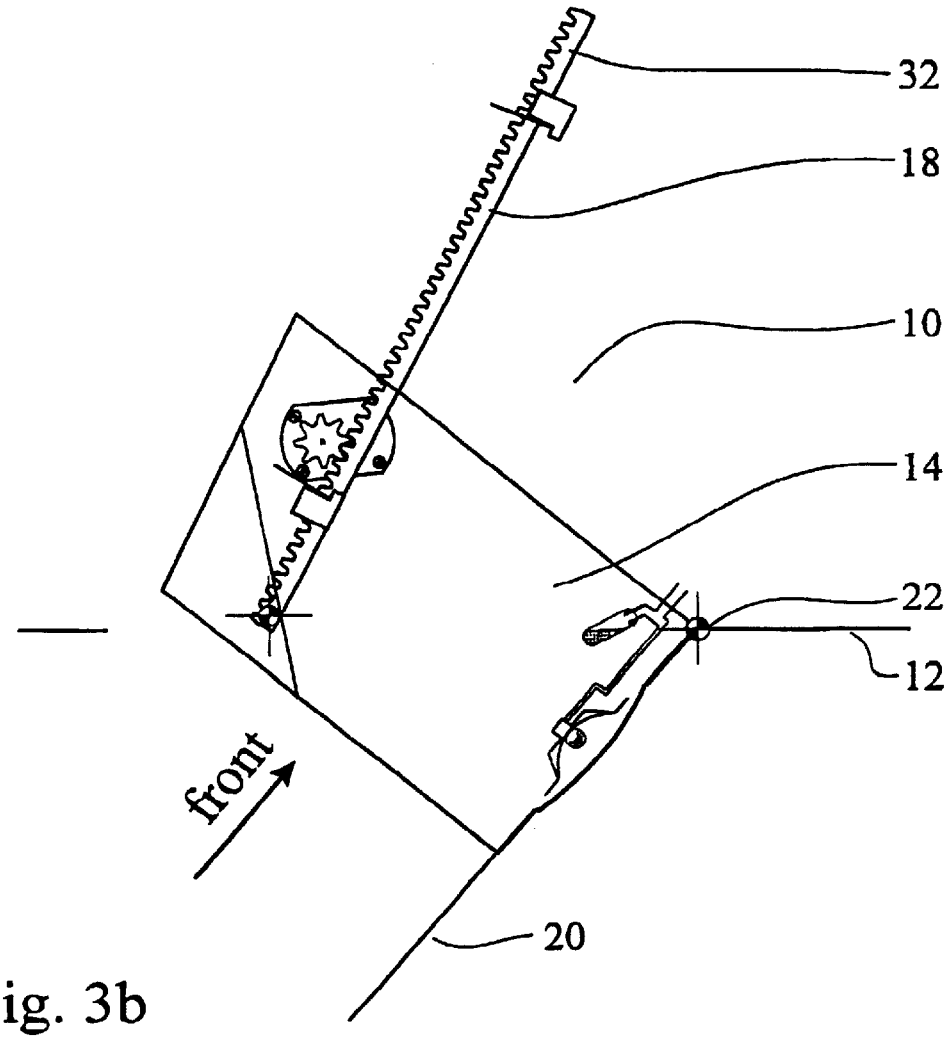
Figure 6A:
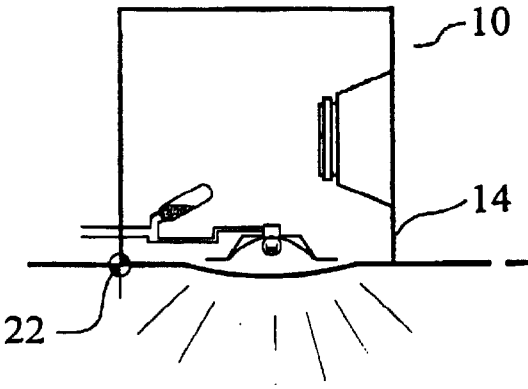
FIGS. 6*a–b,* in cross-sectional side views, illustrate a retractable speaker assembly for a partition, in operation, in accordance with a preferred embodiment of the present invention.
Figure 6B:
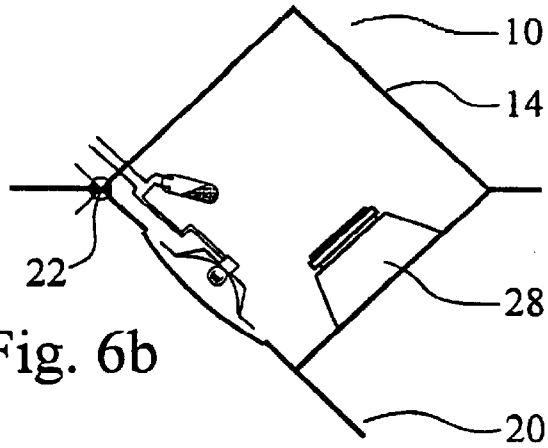
Figure 7A:
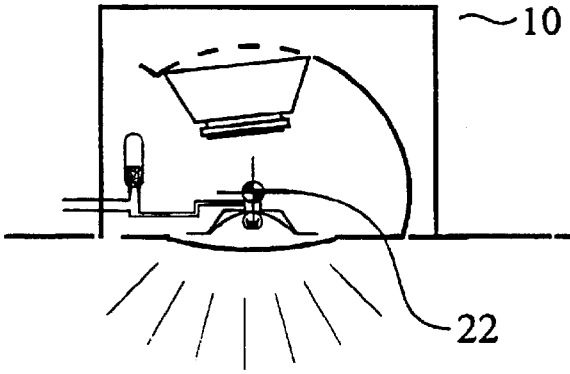
FIGS. 7*a–b,* in cross-sectional side views, illustrate a retractable speaker assembly for a partition, in operation, in accordance with a preferred embodiment of the present invention.
Figure 7B:
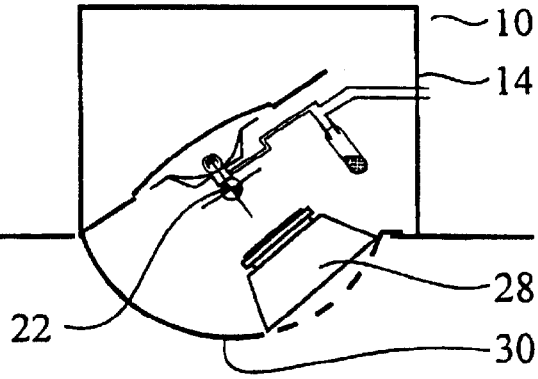
Figure 8A:
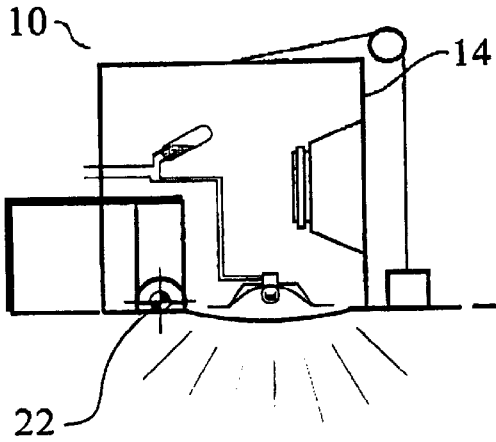
FIGS. 8*a–b,* in cross-sectional side views, illustrate a retractable speaker assembly for a partition, in operation, in accordance with a preferred embodiment of the present invention.
Figure 8B:
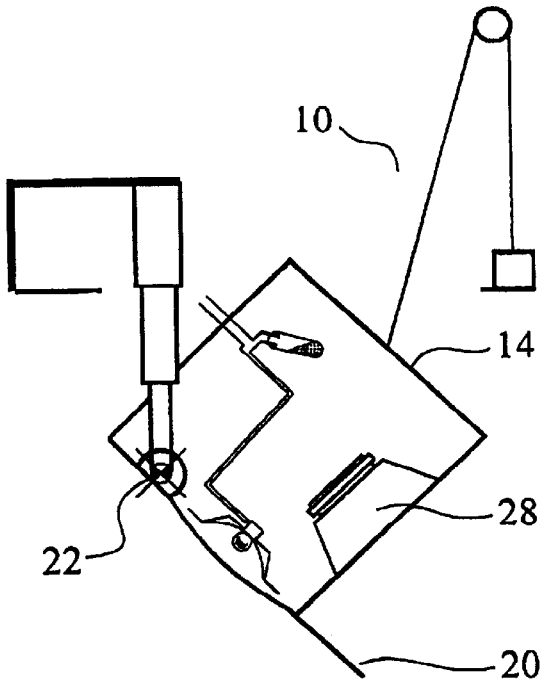
Figure 9A:
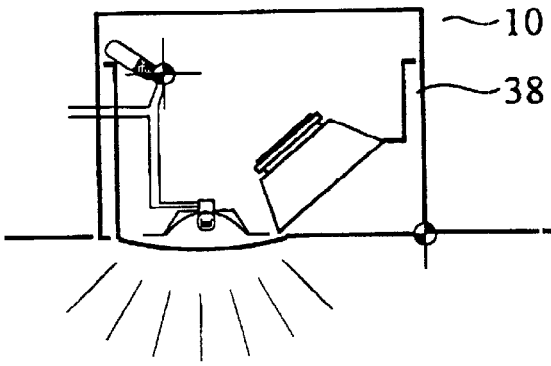
FIGS. 9*a–b,* in cross-sectional side views, illustrate a retractable speaker assembly for a partition, in operation, in accordance with a preferred embodiment of the present invention.
Figure 9B:
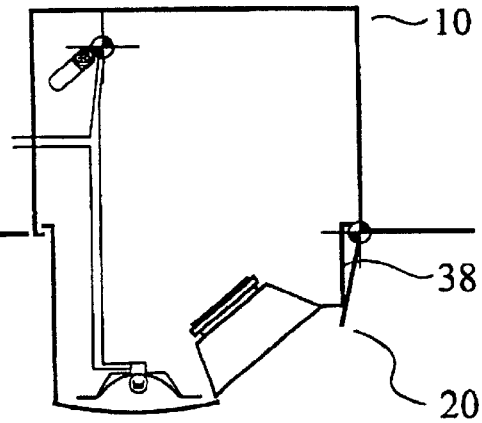
Figures 10A, 10B:
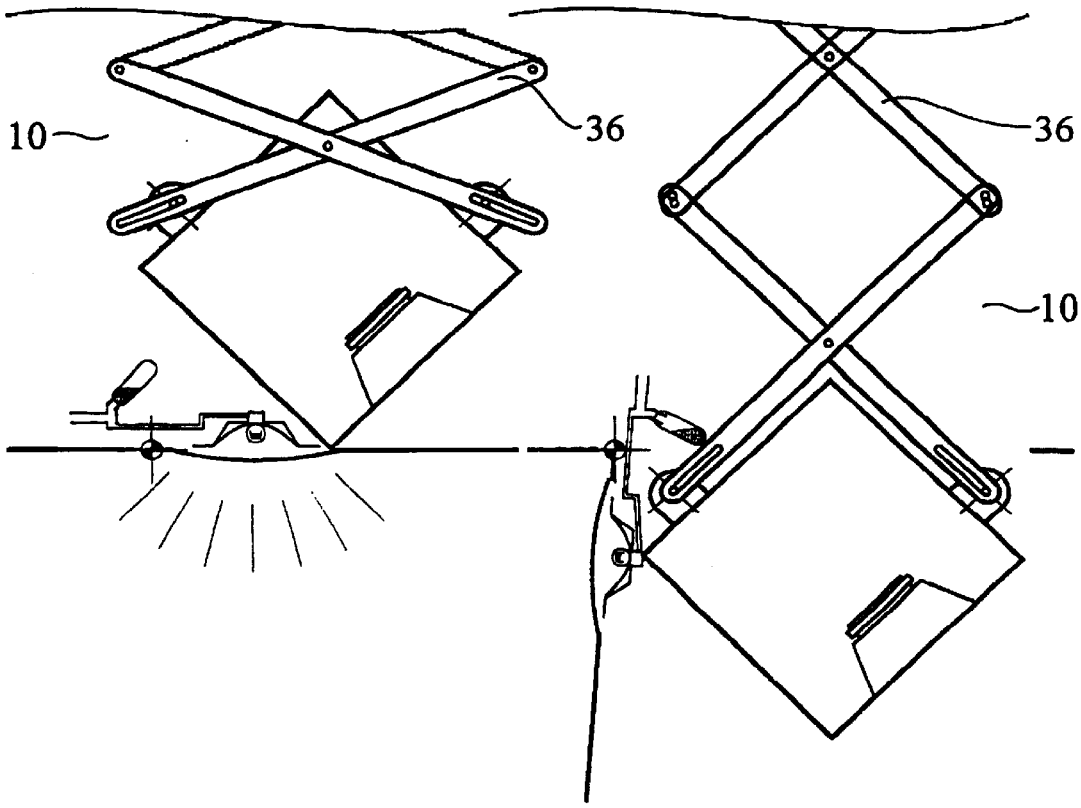
FIGS. 10*a–b,* in cross-sectional side views, illustrate a retractable speaker assembly for a partition, in operation, in accordance with a preferred embodiment of the present invention.
Figure 11A:
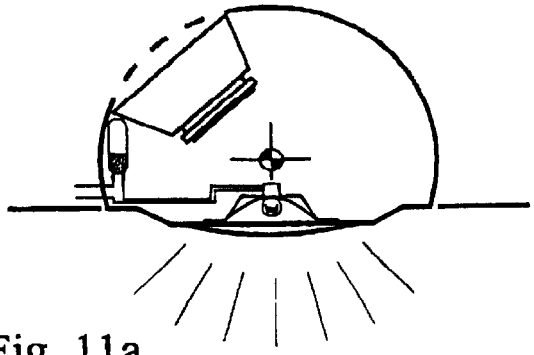
FIGS. 11*a–b,* in cross-sectional side views, illustrate a retractable speaker assembly for a partition, in operation, in accordance with a preferred embodiment of the present invention including a movable lighting means.
Figure 11B:
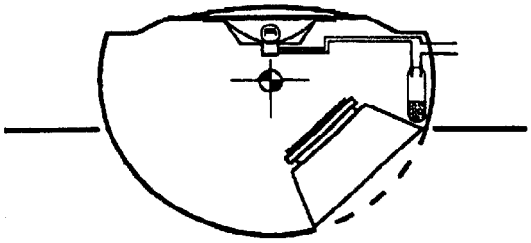
Figure 12A:
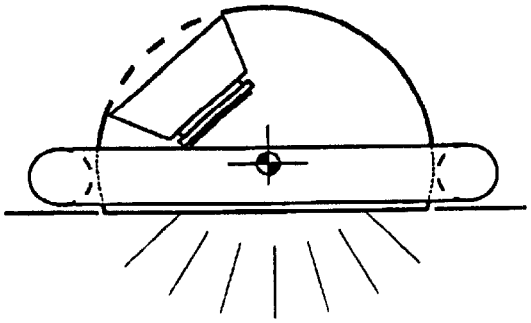
FIGS. 12*a–b,* in cross-sectional side views, illustrate a retractable speaker assembly for a partition, in operation, in accordance with a preferred embodiment of the present invention including a stationary l amp.
Figure 12B:
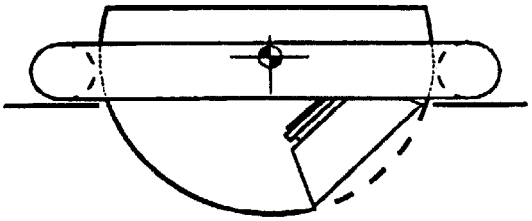

In the drawings, preferred embodiments of the invention are illustrated by way of example. It is to be expressly understood that the description and drawings are only for the purpose of illustration and as an aid to understanding, and are not intended as a definition of the limits of the invention.

BEST MODE FOR CARRYING OUT THE INVENTION

In the description which follows, like parts are marked throughout the specification and the drawings with the same respective reference numerals. The drawings are not necessarily to scale and in some instances proportions may have been exaggerated in order to more clearly depict certain features of the invention.

Referring to FIGS. 1*a–d,* 2*a–b* and 3*a–b,* there is illustrated a retractable speaker assembly 10 for a partition 12 in accordance with a preferred embodiment of the invention. The retractable speaker assembly 10 for a partition 12 includes a housing 14, a cavity 16, an actuator 18 and a panel 20. The housing 14 may be retractable or displaceable from a first closed position to a second operable position by the actuator 18. In the first closed position, the housing 14 is concealed by the partition 12 and the panel 20, whereas the housing 14 is exposed in a second operable position. The panel 20 is associated with the housing 14 so that the cavity 16 where the retractable speaker assembly 10 is inserted and installed, is concealed or closed when the housing 14 is in the first closed position. The housing 14 may be further defined as a speaker 28 and a platform 30. The platform 30 may be structured so that it can rotate with the speaker 28 about a pivot means 22.

The panel 20 which is associated with the housing 14 may be retractable or displaceable to the partition 12 by the pivot means 22. The pivot means 22 may be a hinge. The partition 12 may be a ceiling or wall of a room.

In operation as shown in FIGS. 1 through 10, the retractable speaker assembly 10 is resting in the first closed position, wherein the housing 14 is concealed by the panel 20 and the partition 12. Upon the activation of the retractable speaker assembly 10, the housing 14 moves to the second operable position by the actuator 18. The pivot means 22 allows for the housing 14 to be displaceable or retractable relative to the partition 12 when the housing 14 moves from the first closed position to the second operable position. The panel 20 may extend beyond the housing 14 so as to conceal the cavity 16.

The installation of the retractable speaker assembly 10 may include defining a cavity 16 between two joists 26, for the insertion of the retractable speaker assembly 10. The retractable speaker assembly 10 may be secured into the partition 12 or ceiling by fasteners (not shown). The retractable speaker assembly 10 may be installed at such an angle so as to provide optimum sound when in operation.

The actuator 18, as shown through FIGS. 1–10 and 14 may be one of the following, but not limited to: a rack and pinion means 32, telescoping means 34, a bellows mechanism, 35 a pneumatic piston mechanism, a scissor means 36, or a ratchet mechanism 38. The actuator 18 may include an electric motor (not shown) thereby moving said retractable assembly 10 from a first closed position to a second operable position. In FIGS. 4*a–b* and 7*a–b,* the pivot means 22 may be associated with the housing 14 and the internal structure of the partition 12 thereby allowing the housing 14 to rotate about the pivot means 22 moving the retractable speaker assembly 10 between a first closed position to a second operable position.

Referring to FIGS. 1–13, the retractable speaker assembly 10 may include a lightening means 40. The lightening means 40 may be mounted on to the panel 20 so that when the retractable speaker assembly 10 is in the first closed position, the lighting means 40 is visible to occupants of the room. When the retractable speaker assembly 10 is activated into the second operable position, the lighting means 40 is rotated up into the cavity 16, and the speaker 28 is visible to the occupants of the room. The lighting means 40 may be activated and deactivated by a mercury switch 50. The lighting means 40, such as a fluorescent tube light, may also be mounted to the partition 12 so that it is stationary when the speaker 28 moves between the first closed position and the second operable position.

Figure 13:
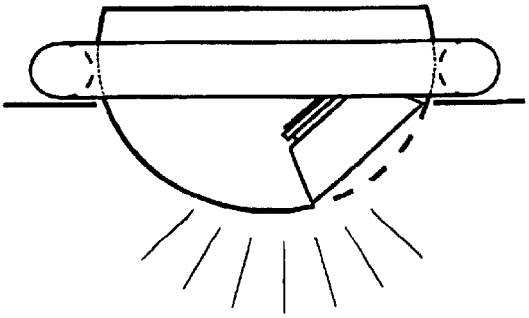
FIG. 13, in a cross-sectional side view, illustrates a retractable speaker assembly for a partition, by manual operation, in accordance with a preferred embodiment of the present invention.
Figure 14B:
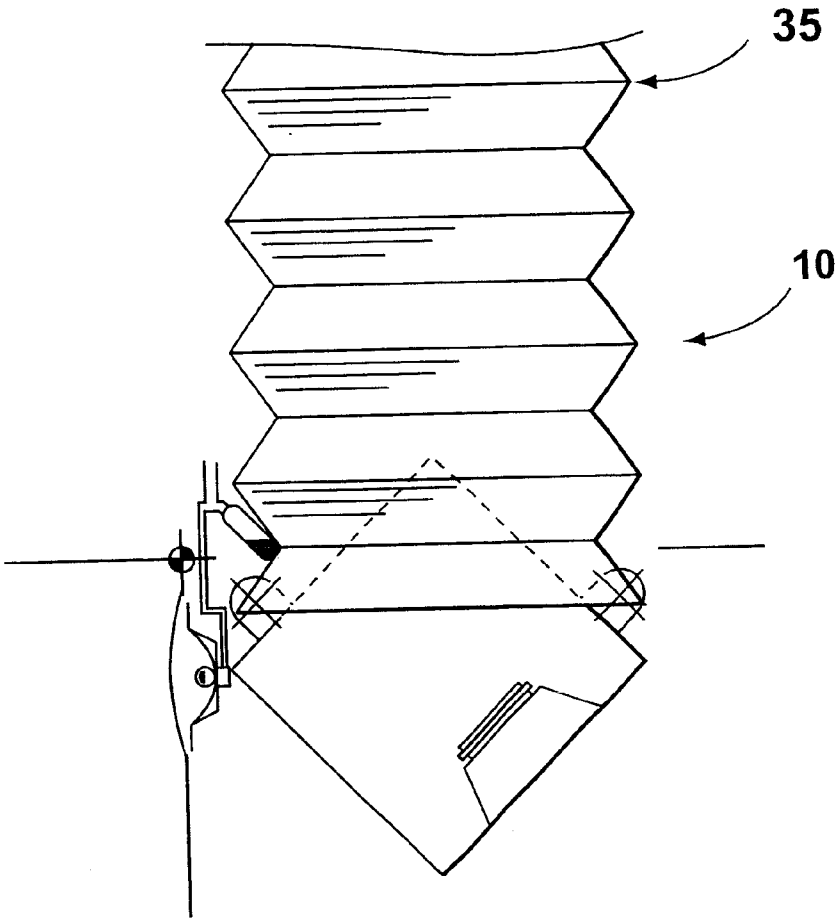
FIGS. 14*a–b,* in cross-sectional views, illustrates a retractable speaker assembly in accordance with the preferred embodiment of the present invention.
Figure 14A:
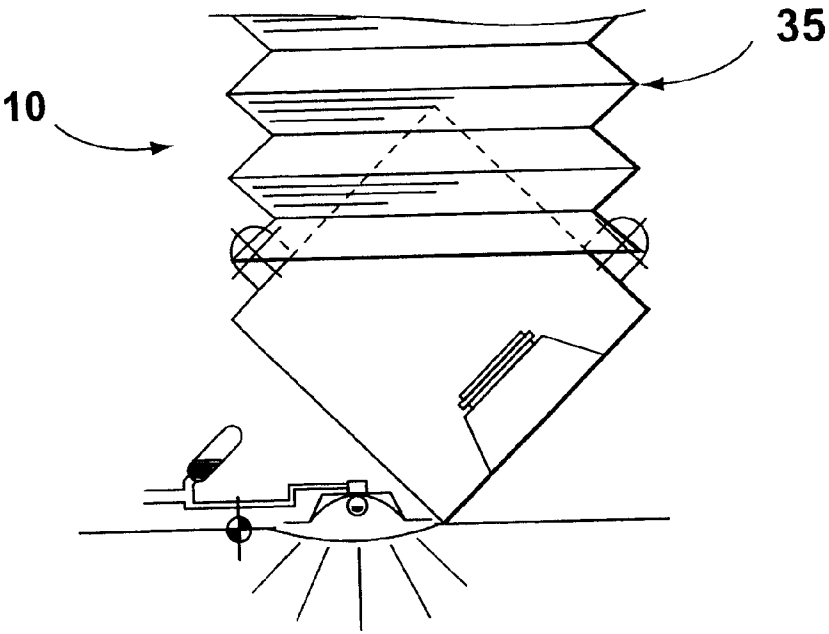

Referring to FIG. 13, the retractable speaker assembly 10 may be movable from the first closed position to the second operable position by manually rotating or tilting the housing 14 so that the panel 20 is concealed by the cavity and the speaker 28 is exposed to the occupants of the room. The retractable speaker assembly 10 may rotate 360° about the pivot means 22.

Various embodiments of the invention have now been described in detail. Since changes in and/or additions to the above-described best mode may be made without departing from the nature, spirit or scope of the invention, the invention is not to be limited to said details.

We claim:

1. A concealable retractable housing for a speaker assembly for a planar ceiling in a room comprising:

(a) a housing member having a partition and an internal axis;

(b) a cavity above said planar ceiling, said partition having identical dimensions to said cavity; and (c) an actuator wherein in a closed position, said housing member rests within said cavity above said planar ceiling and said partition is flush to said ceiling's plane concealing said cavity so that there is no distinction between said ceiling and said partition; said housing member moving to an operable position by said actuator; said speaker assembly and housing member rotatable 360° about said internal axis of said housing member within said cavity by a pivot means.

2. A concealable retractable housing as claimed in claim 1 wherein said actuator is selected from the group consisting of a rack and pinion means, a telescoping means, and a scissor means.

3. A concealable retractable housing as claimed in claim 2 wherein said housing member pivots about an internal axis of said housing member from said closed position to said operable position.

4. A concealable retractable housing as claimed in claim 3 further comprising a lighting mechanism mounted in said partition for use in said closed position.

* * * * *